United States Patent [19]

Keldenich

[11] 4,150,628

[45] Apr. 24, 1979

[54] TRANSVERSELY SHIFTABLE PIVOTALLY MOUNTED SCHNABEL CAR

[75] Inventor: Josef Keldenich, Essen, Fed. Rep. of Germany

[73] Assignee: Fried. Krupp GmbH, Essen, Fed. Rep. of Germany

[21] Appl. No.: 745,770

[22] Filed: Nov. 29, 1976

[30] Foreign Application Priority Data

Nov. 28, 1975 [DE] Fed. Rep. of Germany ..... 2553503

[51] Int. Cl.[2] ..... B61D 3/12; B61D 3/16; B61D 17/00; B61F 5/20

[52] U.S. Cl. ..... 105/367; 105/183

[58] Field of Search ..... 105/367, 183

[56] References Cited

U.S. PATENT DOCUMENTS

| | | | |
|---|---|---|---|
| 3,532,061 | 10/1970 | Bohm et al. | 105/367 X |
| 3,648,622 | 3/1972 | Lich | 105/367 |
| 3,788,237 | 1/1974 | Dieckman et al. | 105/367 |
| 3,837,296 | 9/1974 | Fedele | 105/367 |

FOREIGN PATENT DOCUMENTS

| | | | |
|---|---|---|---|
| 1251791 | 10/1967 | Fed. Rep. of Germany | 105/367 |

*Primary Examiner*—Robert G. Sheridan
*Assistant Examiner*—Howard Beltran
*Attorney, Agent, or Firm*—Walter Becker

[57] ABSTRACT

A heavy load railway vehicle or schnabel car in which a load bridge is disposed between a pair of longitudinally spaced rail supported bogies and is supported on the bogies by arms on the ends of the load bridge which extend outwardly over the bogies and engage an outer guide means in the longitudinal center of each bogie and an inner guide means near the inner end of each bogie. Each guide means is laterally movable on the respective bogie and the inner guide means is resiliently acted upon from opposite side to bias the inner guide means toward a predetermined position on the respective bogie.

7 Claims, 9 Drawing Figures

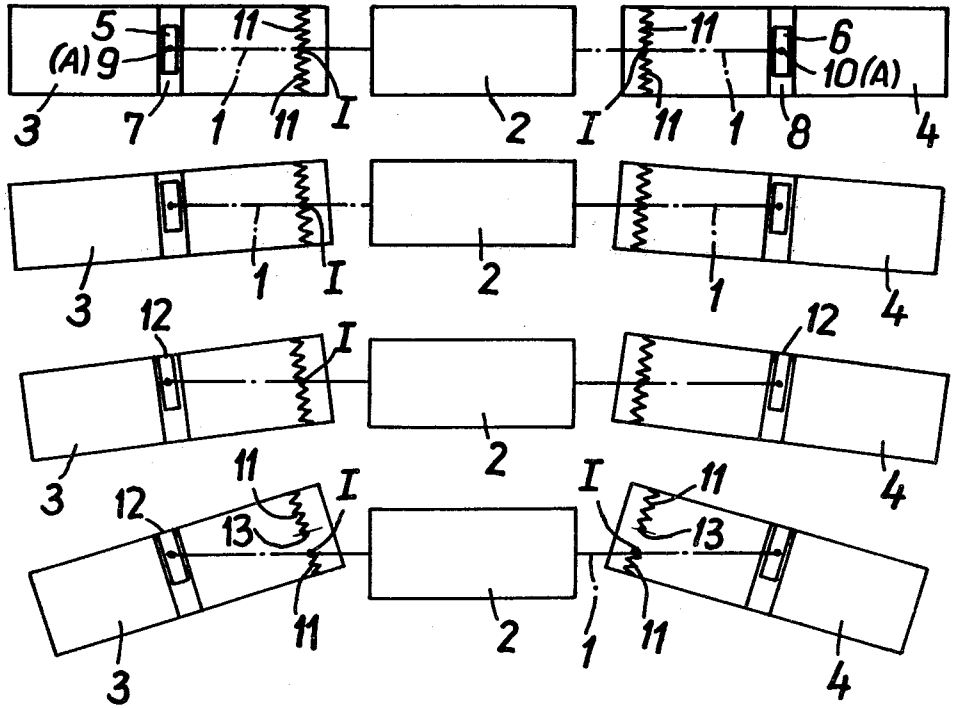
FIG. 1a
FIG. 1b
FIG. 1c
FIG. 1d
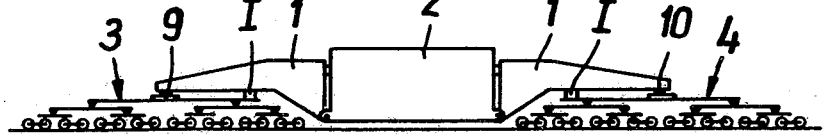
FIG. 2

TRANSVERSELY SHIFTABLE PIVOTALLY MOUNTED SCHNABEL CAR

The present invention relates to a heavy load railway vehicle or schnabel car with two bogies each having an outer and an inner guiding means, and with a loading bridge, especially a support jaw or nose car for interconnecting said bogies. These outer guiding means rest through the intervention of a sliding device which is laterally and substantially horizontally displaceable, said inner guiding means being displaceable in a horizontal direction.

With heretofore known heavy load railway vehicles or schnabel car which are provided with outer and inner guiding points, and which have a relatively long length, the so-called outer guiding point serves for the load transfer from the load carrier or respective support jaw or nose onto the bogie. With a practical embodiment of such an arrangement, generally a joint bearing which is arranged in the center of the bogie is employed.

In order when driving along curved tracks to reduce the curved track throw which in view of the length of the vehicle is frequently considerable, so-called inner guiding points were provided. The inner guiding points represent joint connections between the bogie and the load carrier which connections are relative to the outer guiding points arranged closer to the vehicle center and do not absorb any bearing forces.

The bearing forces are as before absorbed by the outer guiding points while the outer guiding point as a rule is arranged on a laterally displaceable sliding device.

During the drive of the vehicle, either the outer or the inner guiding points only must be effective. If the driving is effected with inserted inner guiding points, the sliding device will in the curves laterally deviate in conformity with the radius of curvature. The outermost bypass position is determined by the stability of the bogie and the admissible values of the wheel load which is displaced toward one side. Furthermore, the guiding of the carriage of the sliding device has usually an end limit. When during driving with inserted inner guiding points, the respective admissible end position of the outer guiding means has been reached, it is necessary, in order that still narrower curves can be driven through, the inner guiding means be disengaged. For this operation, it is necessary with heretofore known rail vehicles, to stop, to disengage the inner guiding means, in order then to be able to continue to drive with the arrested outer guiding means. After the narrow curve has been passed through, the same operation has to be repeated in an inverse sequence. The same manipulation is necessary when the load is displaced to one side in a straight track section. The carriage of the sliding device may be moved in the respective desired position, by displacing devices, usually hydraulic displacing devices.

The drawbacks of the heretofore known heavy load rail vehicle is seen in that the operating team has continuously to watch and check the timely guiding point change. If the change of the guiding points is not effected at the right time, the structure will move into a forced position and can easily be destroyed. Furthermore, the continuous guiding point change during the drive results in a considerable time loss in view of the required respective stopping.

It is, therefore, an object of the present invention to avoid the above mentioned drawbacks, faulty steering by the operating team, and time losses during the guiding point change.

These and other objects and advantages of the invention will appear more clearly from the following specification in connection with the accompanying drawings, in which:

FIGS. 1*a* to 1*d* respectively illustrate a top view of a heavy load rail vehicle in four different positions.

FIG. 2 is a side view of the vehicle.

Figure 3:
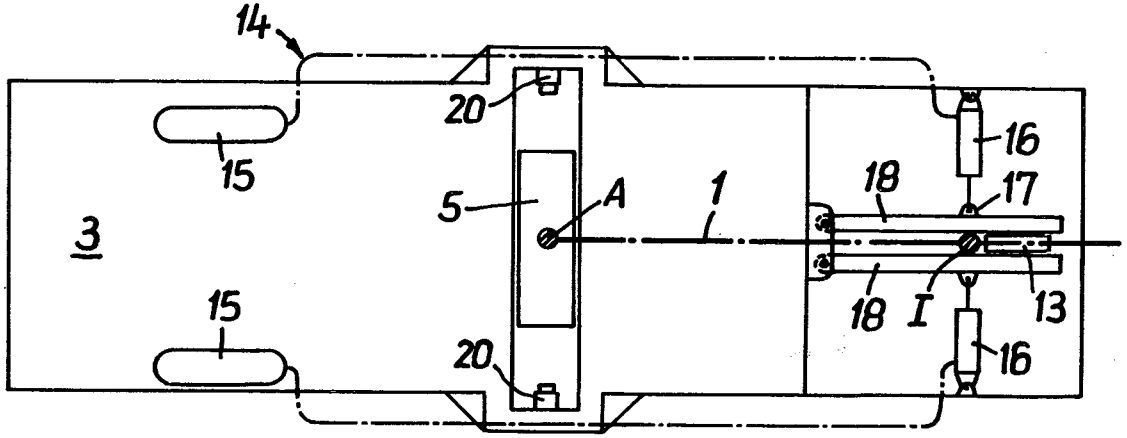
FIGS. 3 and 4 respectively represent a top view of a bogie of a modified embodiment of the vehicle on a larger scale according to FIGS. 1*a* and 1*d*.
Figure 4:
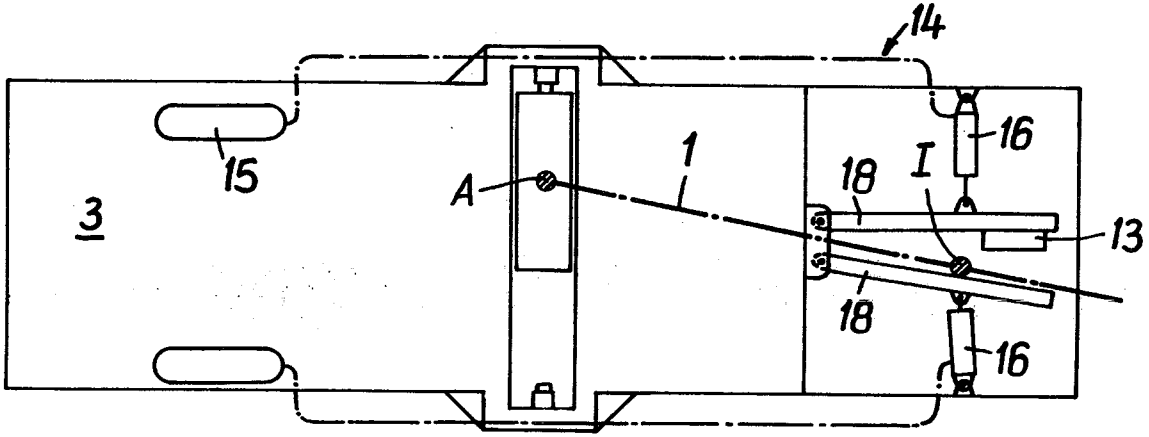

The problem underlying the present invention has been solved according to the invention in that the inner guiding means are laterally displaceable and on both sides are provided with devices respectively which exert a lateral force onto the inner guiding point.

With the vehicle according to the invention, even when driving, an action by the operating team "beyond the inner guiding point" is no longer necessary whereby possible faulty steering operations will be avoided. According to a further development of the invention, it is provided that the lateral forces equals or is greater than the maximum possible counterforce as a consequence of a force directed down a slope along banked tracks. In this way, no special safety steps have to be taken when the vehicle has to drive on tracks comprising banked rails.

It is particularly advantageous when as device exerting the lateral forces there is provided a pneumatically or hydraulically operating device. By means of this device, the lateral force can also at the greatest possible inner point displacement be kept at the same magnitude or it can easily be changed by a corresponding control device and can be adjusted to the respective required or desired value.

A further advantageous design of the invention consists in that the respective deviation of the laterally displaceable sliding devices is limited by adjustable lateral abutments. In this way, it will be possible prior to the starting of the drive of the vehicle to determine the permissible lateral end position of the outer guiding point which is dependent on the respective load, and to adjust the lateral deviation accordingly.

Referring now to the drawings in detail, the construction and operation of the vehicle according to the invention is principly shown in FIGS. 1*a*–1*c*. The load 2 suspended between the indicated supporting jaw nose or extremity 1 is located between the two bogies 3 and 4. The displacement carriages 5 and 6 represent horizontally displaceable sliding devices and are mounted in straight guiding means 7 and 8. The bearing sockets 9 and 10 arranged in the center of the displacement carriages represent the outer guiding points A. The inner guiding points or abutments I are represented by the points of attack which are acted upon by means of the preloaded springs 11 by the lateral force, and which points of attack are arranged on the supporting jaw nose or extremity 1. Inasmuch as the lateral force equals or exceeds the largest possible counter force in view of the force directed down a slope with banked tracks, the preload of the springs 11 is adjustable. The springs 11 should furthermore have a flat line of characteristic.

FIG. 1*a* shows the position of the vehicle when driving along a straight path. On the other hand, FIGS. 1*b*–1*d* illustrate the various positions with increasing curvature of the track arcs. From FIG. 1*b* it will be seen that the inner guiding points I retain their position, whereas the outer guiding points A move outwardly toward the outside of the curvature of the track. In FIG. 1*c*, the outward movement of the outer guiding points A has reached its end position at the lateral abutments 12. At the latest in this position, it is necessary with the heretofore known heavy load rail vehicles to stop and to disengage the inner guiding point. Such step is not necessary with the vehicle according to the invention as will be seen from FIG. 1*d*. the springs 11 provided on the inner side of the arc of the track become shortened and permit an outward movement of I toward the inner side of the curved track, whereas the outer guiding points A remain in their outermost end position. No action of the operator will therefore be necessary during the driving operation. The springs 11 respectively arranged on the outside of the curved track section are by abutments 13 prevented from a further extension, said sbutments 13 being arranged approximately in the lateral axis of the bogie.

Figure 5:
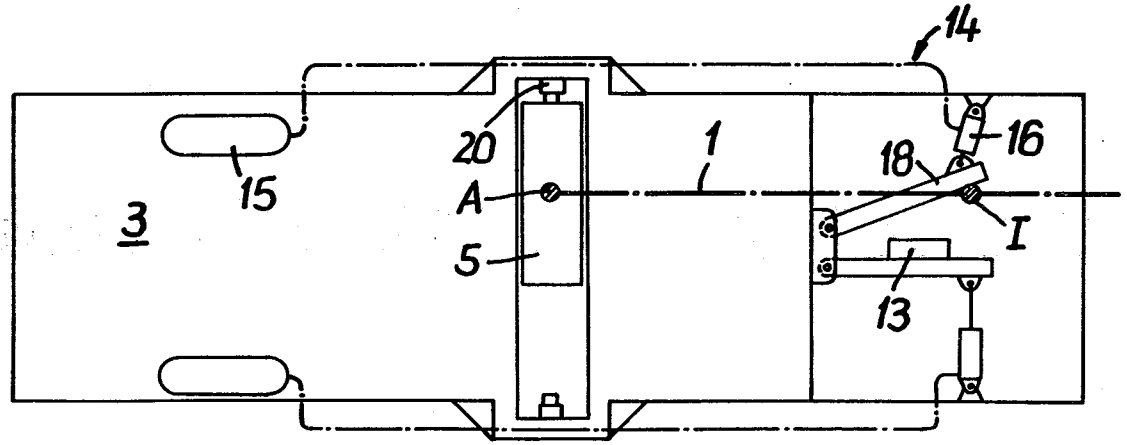
FIG. 5 shows the embodiment of FIG. 3 with the lateral displacement of the load.

According to the embodiment of FIG. 3, instead of the springs 11 there are provided two hydro-pneumatically acting devices 14 respectively comprising storage means 15 and a hydraulic working cylinder 16. The storage means are embodied in the form of known piston storage means, hydropneumatic resilient means or diaphragm storage means. The lateral forces respectively attack at an eye 17 of a one-arm lever 18. The abutments 13 are in the illustrated straight driving position not acted upon by the levers 18. The lateral abutments 20 for the displacement carriage 5 are adjustable; accordingly, laterally adjustable abutments are provided for limiting the lateral movement of at least one of the guid means on each bogie. FIG. 5 shows the outermost position of a lateral displacement of the load during straight driving. To this end, a non-illustrated displacing device for the displacement carriage 5 is made effective by means of which the said carriage 5 is moved into the respective desired lateral position. Such lateral displacements can be effected by the new vehicle also while driving. This results in a further advantage. After the lateral displacement has been completed, the displacing device for the displacement carriage is again disengaged, and the hydraulic working cylinders 16 and the preloaded springs 11 return the load automatically to its normal central position.

Figure 6:
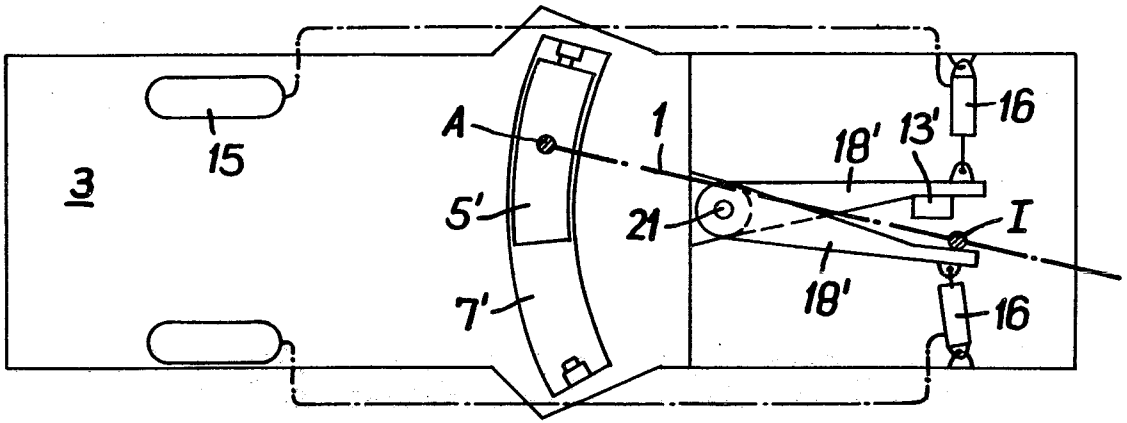
FIG. 6 is a top view of a bogie according to a further embodiment of the invention.

A displacement carriage 5' which is mounted in an arc-shaped guiding means 7' is shown in the embodiment according to FIG. 6. This embodiment has the advantage that in combination with a correspondingly selected arrangement of the pivot point 21 of levers 18', the inner guiding point I arranged on the supporting jaw, nose or end portion 1 does not carry out any relative movement with regard to the levers 18 or at least carries out such movement to a negligible small extent.

It is, of course, to be understood that in practice not the illustrated line contact but a surface contact for instance in the form of a so-called coulisse stone is provided. Similarly, various other modifications are possible for realizing the principle of the present invention. Therefore, it is to be understood that the present invention is, by no means, limited to the specific showing in the drawings, but also comprises any modifications within the scope of the appended claims.

What is claimed is:

1. A rail vehicle for transporting heavy loads, having a pair of bogies in spaced relation and a load bridge between said bogies and having supports at its extremities extending over and supported on said bogies to interconnect said bogies, each of said supports supporting one extremity of said load bridge on a bogie for transverse and pivotal movement relative to said bogies, each bogie having outer guide means intermediate its ends supportingly engaging the support on said bogie for movement transversely of the bogie, each bogie having inner guide means engaging the support between the outer guide means and the end of the respective bogie nearest the load bridge, each said outer guide means including means slidable laterally on its respective bogie, and abutments at each side of the bogie limiting the alidable movement, each inner guide means being displaceable horizontally relative to its respective bogie in the lateral direction, and laterally acting biasing means on each side of said support engaging and independently urging each said inner guide means toward a central position of said support on its respective bogie.

2. A vehicle in combination according to claim 1 in which the force exerted on said inner guide means is at least equal to any counterforce developed on the load bridge in view of a force directed down a slope with banked tracks on which the bogies run.

3. A vehicle in combination according to claim 1 in which said biasing means comprise spring means acting between each said inner guide means and the respective bogie.

4. A vehicle in combination to claim 1 which said biasing means comprise hydro-pneumatically operable means.

5. A vehicle in combination according to claim 1 which includes abutment means near each inner guide means operable for sustaining the thrust of said biasing means when said inner guide means in in said predetermined position.

6. A vehicle in combination according to claim 1 in which said biasing means comprises a pair of opposed biasing elements acting on each inner guide means, and abutment means stationary on each bogie near the inner guide means thereon and operable to sustain the thrust of each said biasing element when the inner guide means moves from said predetermined position thereof in the direction in which the respective biasing element acts.

7. A rail vehicle for supporting a load, in which a load bridge extends between two bogie structures, said load bridge having each extremity extending over and connected to a bogie structure, each bogie structure having means between its ends pivotally connected to one extremity of said load bridge and supporting said one extremity of said load bridge between abutment means on the sides of said bogie structure to limit transverse movement of said one extremity of said load bridge, each bogie also having laterally acting biasing means on each side of said load bridge between said means supporting said load bridge and one end of said bogie, each of said laterally acting biasing means acting to urge said extremity of said load bridge to move about its pivot and transversely of said bogie structure toward the center of said bogie structure, so that when said load bridge moves angularly and laterally relative to said bogie structure, at least one of said laterally acting biasing means urges said load bridge toward its central position on said bogie structure.

* * * * *